US010089906B2

(12) United States Patent
Warnes et al.

(10) Patent No.: US 10,089,906 B2
(45) Date of Patent: Oct. 2, 2018

(54) APPARATUS FOR INTERIOR SIGNPOST SUPPORT

(71) Applicants: Mylan D. Warnes, Ogden, UT (US); Sue M. Warnes, Ogden, UT (US)

(72) Inventors: Mylan D. Warnes, Ogden, UT (US); Sue M. Warnes, Ogden, UT (US)

(73) Assignees: Mylan D. Warnes, Ogden, UT (US); Sue M. Warnes, Ogden, UT (US)

( * ) Notice: Subject to any disclaimer, the term of this patent is extended or adjusted under 35 U.S.C. 154(b) by 1 day.

(21) Appl. No.: 15/373,331

(22) Filed: Dec. 8, 2016

(65) Prior Publication Data

US 2017/0193862 A1 Jul. 6, 2017

Related U.S. Application Data

(60) Provisional application No. 62/275,683, filed on Jan. 6, 2016.

(51) Int. Cl.

| | |
|---|---|
| ***E04H 12/22*** | (2006.01) |
| ***G09F 7/18*** | (2006.01) |
| ***G09F 19/22*** | (2006.01) |
| *A45F 3/44* | (2006.01) |

(52) U.S. Cl.

CPC ..... *G09F 7/18* (2013.01); *G09F 19/228* (2013.01); *A45F 3/44* (2013.01); *E04H 12/2215* (2013.01); *G09F 2007/1804* (2013.01)

(58) Field of Classification Search

USPC ..... 248/156, 530; 40/607.05

See application file for complete search history.

(56) References Cited

U.S. PATENT DOCUMENTS

| | | | | |
|---|---|---|---|---|
| 672,625 | A | 4/1901 | Mullenix | |
| 775,759 | A | 11/1904 | Meinecke | |
| 2,030,378 | A * | 2/1936 | Lippold | G09F 7/22 40/617 |
| 4,156,332 | A | 5/1979 | Thompson | |
| 4,249,715 | A * | 2/1981 | Repp | E01F 9/685 248/156 |
| 4,279,104 | A | 7/1981 | Classen | |
| 4,326,352 | A * | 4/1982 | Barth | E01F 9/623 248/156 |

(Continued)

FOREIGN PATENT DOCUMENTS

| | | |
|---|---|---|
| CN | 204225105 | 3/2015 |
| DE | 29723219 | 8/1998 |

(Continued)

*Primary Examiner* — Alfred J Wujciak

(74) *Attorney, Agent, or Firm* — Kunzler, PC

(57) ABSTRACT

An apparatus for a signpost includes a vertical bar comprising a first end and a second end. The apparatus includes an upper bar coupled to the vertical bar. The upper bar includes a center portion substantially perpendicular to the vertical bar and two vertical portions coupled to the center portion. Each vertical portion is coupled to the center portion distal to a connection point to the vertical bar. The apparatus includes a ground anchor coupled to the vertical bar between the upper bar and the second end of the vertical bar. The ground anchor includes one or more spikes oriented toward the second end of the vertical bar, and a tab coupled to the ground anchor and oriented extending away from the ground anchor.

20 Claims, 7 Drawing Sheets

(56) References Cited

U.S. PATENT DOCUMENTS

| | | | | | |
|---|---|---|---|---|---|
| 4,483,506 | A * | 11/1984 | Litwiller | E01F 9/685 | 248/156 |
| 4,530,190 | A | 7/1985 | Goodman | | |
| 4,756,128 | A | 7/1988 | Danieli | | |
| 4,803,812 | A | 2/1989 | Alexander, Sr. | | |
| 4,939,877 | A | 7/1990 | Claffey | | |
| 5,123,623 | A | 6/1992 | McNamara | | |
| 5,372,457 | A | 12/1994 | Rante | | |
| 5,722,205 | A * | 3/1998 | Gannaway | E04H 12/2215 | 52/153 |
| 6,725,872 | B2 | 4/2004 | Kindell | | |
| 7,089,694 | B2 * | 8/2006 | Allen | G09F 15/0037 | 173/126 |
| 9,080,587 | B1 | 7/2015 | Smith | | |
| 2001/0045068 | A1 | 11/2001 | Chalich | | |
| 2011/0036026 | A1 | 2/2011 | Lee | | |
| 2011/0308990 | A1 * | 12/2011 | Pounders | E04H 12/2215 | 206/525 |

FOREIGN PATENT DOCUMENTS

| | | |
|---|---|---|
| FR | 2343877 | 10/1977 |
| GB | 365517 | 10/1930 |
| GB | 2250758 | 8/1991 |
| NL | 9000334 | 9/1991 |

* cited by examiner

Section A-A'

Section A-A'

Section B-B'

APPARATUS FOR INTERIOR SIGNPOST SUPPORT

CROSS-REFERENCES TO RELATED APPLICATIONS

This application claims the benefit of U.S. Provisional Patent Application No. 62/275,683 entitled "APPARATUS FOR INTERIOR SIGNPOST SUPPORT" and filed on Jan. 6, 2016 for Mylan D. Warnes, et al., which is incorporated herein by reference.

FIELD

This invention relates to signs and more particularly relates to an improved signpost support.

BACKGROUND

Often signposts, such as real estate signposts, are inserted into the ground and include a horizontal member with a sign hanging from the horizontal member, which creates unequal loading so that after time, the sign often tilts to the side of the horizontal member. Wind and other forces can also loosen the signpost so that the signpost will tilt to one side. The signpost may also rotate, which is often undesirable. In addition, the signpost can come loose due to wind, people hitting the sign, etc.

SUMMARY

An apparatus for a signpost includes a vertical bar with a first end and a second end. The apparatus includes an upper bar coupled to the vertical bar. The upper bar includes a center portion substantially perpendicular to the vertical bar and two vertical portions coupled to the center portion. Each vertical portion is coupled to the center portion distal to a connection point to the vertical bar. The apparatus includes a ground anchor coupled to the vertical bar between the upper bar and the second end of the vertical bar. The ground anchor includes one or more spikes oriented toward the second end of the vertical bar, and a tab oriented extending away from the vertical bar.

In one embodiment, the apparatus includes a vertical signpost member that includes a hollow interior. In another embodiment, the apparatus includes a horizontal signpost member coupled to the vertical signpost member. The horizontal signpost member includes a hollow interior, and includes one or more nuts aligned with an edge of the horizontal signpost member, and one or more eyebolts, where each eyebolt is secured to a nut of the one or more nuts. In another embodiment, the vertical bar includes a rod and the second end is tapered to a point. In another embodiment, the upper bar is bendable to adjust a distance between the two vertical portions to match a width of an interior of a signpost.

In one embodiment, the upper bar couples to the vertical bar below the first end of the vertical bar at a distance from the ground anchor. In a further embodiment, the distance includes a distance sufficient to support a signpost in a vertical position when the vertical bar is inserted into a ground to a depth of the ground anchor. The signpost is placed over the vertical bar. In another embodiment, an end of each vertical portion of the upper bar couples to an end of the center portion of the upper bar distal to the connection point of the center portion to the vertical bar, and each vertical portion extends away from the first end of the vertical bar. In another embodiment, each of the vertical portions of the upper bar includes an angle iron. Each angle iron coupled to the center portion of the upper bar at an interior angle of the angle iron. In another embodiment, the ground anchor includes a plate that includes the one or more spikes and the tab, a width of the plate and a width of the upper bar each have a width of a diagonal of an interior of a signpost.

In one embodiment, a portion of the ground anchor extends toward the first end of the vertical bar a distance away from the tab. In another embodiment, the portion of the ground anchor extending towards the first end of the vertical bar extends an amount sufficient to engage an edge of an interior of a signpost disposed over the ground anchor. In another embodiment, the tab is shaped to fit within an interior of a signpost. In another embodiment, the ground anchor includes a plate, and the plate includes the one or more spikes and the tab. The plate includes a cut and the tab includes a portion under the cut bent away from the plate. In another embodiment, the tab is oriented perpendicular to the vertical bar. In another embodiment, the ground anchor includes two spikes oriented toward the second end of the vertical bar. Each spike has a tip located at a vertical edge of the ground anchor.

A signpost system includes a signpost support apparatus. The signpost support apparatus includes a vertical bar with a first end and a second end, where the second end is tapered to a point, and an upper bar coupled to the vertical bar. The upper bar has a center portion substantially perpendicular to the vertical bar and two vertical portions coupled to the center portion. Each vertical portion is coupled to the center portion distal to a connection point to the vertical bar. The signpost system includes a ground anchor coupled to the vertical bar between the upper bar and the second end of the vertical bar. The ground anchor includes a plate with one or more spikes oriented toward the second end of the vertical bar, and a tab coupled to the ground anchor and oriented extending away from the plate. The signpost system includes a signpost. The signpost includes a vertical signpost member with a hollow interior. The vertical signpost member is inserted over the signpost support apparatus. The signpost includes a horizontal signpost member coupled to the vertical signpost member, where a width of the plate and a width of the upper bar each have a width of a diagonal of an interior of a signpost.

In one embodiment, the horizontal signpost member has a hollow interior, and the signpost system includes one or more nuts aligned with an edge of the horizontal signpost member, and one or more eyebolts, where each eyebolt is secured to a nut of the one or more nuts.

An alternate apparatus for a signpost includes a vertical bar with a first end and a second end. The second end is tapered to a point and the vertical bar includes a rod. The alternate apparatus includes an upper bar coupled to the vertical bar. The upper bar has a center portion substantially perpendicular to the vertical bar and two vertical portions coupled to the center portion. Each vertical portion is coupled to the center portion distal to a connection point to the vertical bar, and an end of each vertical portion of the upper bar couples to an end of the center portion of the upper bar distal to the connection point of the center portion to the vertical bar. Each vertical portion extends away from the first end of the vertical bar. The upper bar is bendable to adjust a distance between the two vertical portions to match a width of an interior of a signpost.

The alternate apparatus includes a ground anchor coupled to the vertical bar between the upper bar and the second end of the vertical bar. The ground anchor includes a plate with one or more spikes oriented toward the second end of the vertical bar, and a tab coupled to the ground anchor and oriented extending away from the plate. The tab is oriented perpendicular to the vertical bar. A portion of the plate extends toward the first end of the vertical bar a distance away from the tab, where the portion of the plate extending towards the first end of the vertical bar extends an amount sufficient to engage an edge of an interior of the signpost disposed over the plate. The upper bar couples to the vertical bar below the first end of the vertical bar at a distance from the ground anchor and the distance is a distance sufficient to support the signpost in a vertical position when the vertical bar is inserted into a ground to a depth of the ground anchor. The signpost is placed over the vertical bar. A width of the plate and a width of the upper bar each include a width of a diagonal of an interior of a signpost.

In one embodiment, the apparatus includes the signpost. The signpost includes a vertical signpost member with a hollow interior, and a horizontal signpost member coupled to the vertical signpost member. The horizontal signpost member has a hollow interior. The horizontal signpost member includes one or more nuts aligned with an edge of the horizontal signpost member, and one or more eyebolts. Each eyebolt is secured to a nut of the one or more nuts.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention, and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the invention may be combined in any suitable manner in one or more embodiments. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
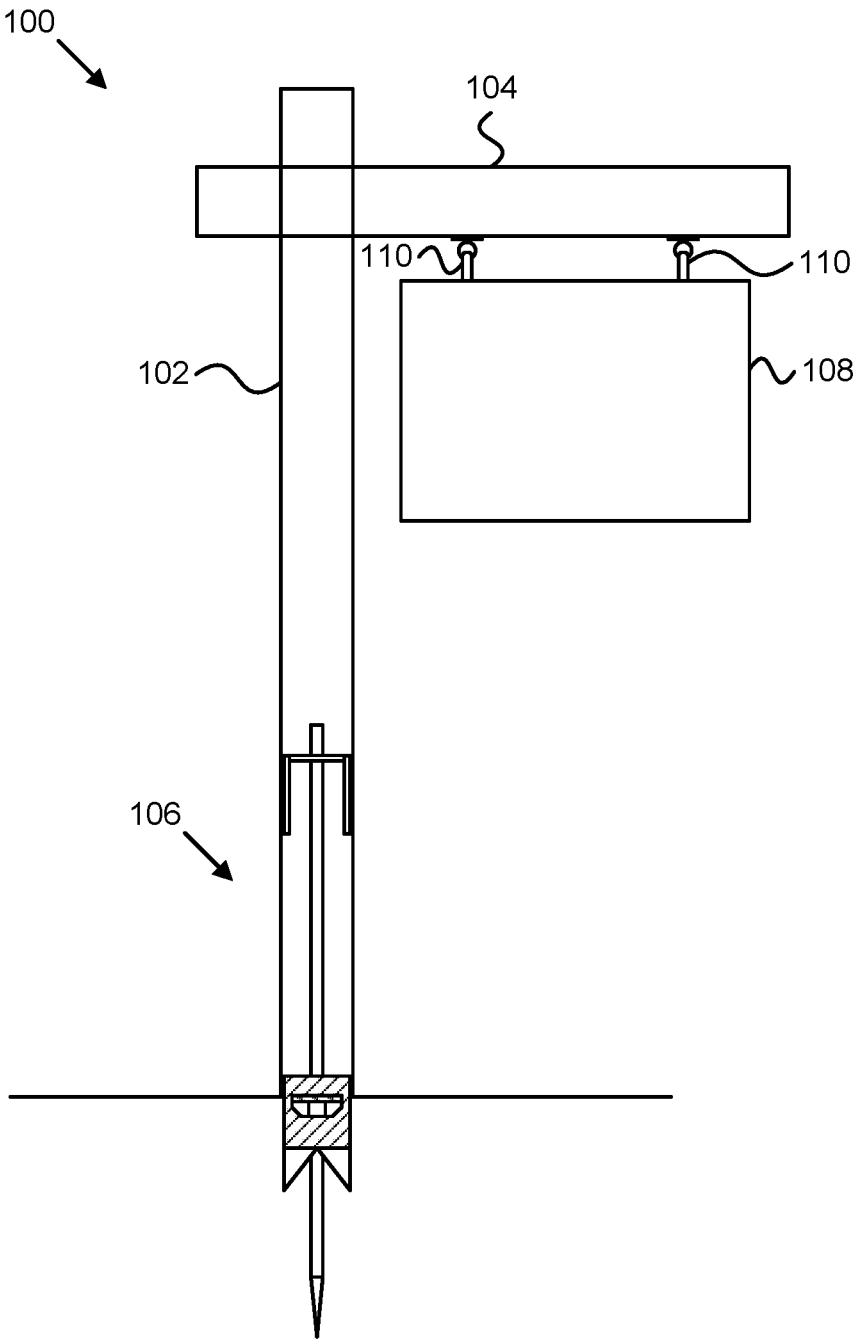
FIG. 1 is a side view illustrating one embodiment of an apparatus for interior signpost support.

FIG. 1 depicts one embodiment of an apparatus 100 for signpost support. The apparatus 100 includes a vertical signpost member 102, a horizontal signpost member 104, and an apparatus for interior signpost support 106. In one embodiment, the apparatus 100 may include a sign 108 with one or more sign connectors 110.

In one embodiment, the apparatus 100 includes a vertical signpost member 102. In one embodiment, the vertical signpost member 102 may be part of a signpost that supports one or more signpost components, such as the horizontal signpost member 104. The vertical signpost member 102, in one embodiment, includes a hollow interior. The hollow interior accommodates the apparatus for interior signpost support 106. In one embodiment, the vertical signpost member 102 is hollow for the portion where the apparatus for interior signpost support 106 is inserted and is solid, includes crossmembers, webbing or other internal component above the apparatus for interior signpost support 106. In another embodiment, the vertical signpost member 102 is hollow throughout except for the horizontal signpost member 104 (where inserted through the vertical signpost member 102), supports for the horizontal signpost member 104, a cap, etc.

In one embodiment, the hollow interior may include a rectangular hollow interior. In certain embodiments, the hollow interior may include a square hollow interior, a circular hollow interior, or another shaped hollow interior. As used herein, a rectangular hollow interior includes various rectangular shapes, which may also include a square hollow interior. In one embodiment, the vertical signpost member 102 includes corners, sides, etc. that accommodate the apparatus for interior signpost support 106 where portions of the apparatus for interior signpost support 106 are shaped to fit into the corners, against the sides, etc. The vertical signpost member 102 may include an opening disposed on an end of the vertical signpost member 102. In one embodiment, the opening is positioned toward the ground and may rest on the ground.

In one embodiment, the apparatus 100 includes a horizontal signpost member 104. The horizontal signpost member 104 may couple to the vertical signpost member 102. For example, in one embodiment, the vertical signpost member 102 may include an opening and the horizontal signpost member 104 may protrude through the opening. In another embodiment, the horizontal signpost member 104 bolts to a side of the vertical signpost member 102. In another embodiment, the horizontal signpost member 104 includes an opening and the vertical signpost member 102 protrudes through the opening. In the embodiment, the vertical signpost member 102 may include a stop and the horizontal signpost member 104 may rest on top of the stop. In one embodiment, the horizontal signpost member 104 may include a hollow interior. In one embodiment, the hollow interior may include a rectangular hollow interior. In certain embodiments, the hollow interior may include a square hollow interior, a circular hollow interior, or another shaped hollow interior.

In one embodiment, the apparatus 100 includes an apparatus for interior signpost support 106. The apparatus for interior signpost support 106 may be placed in the ground. A signpost, such as the vertical signpost member 102 may be placed over the apparatus for interior signpost support 106. The apparatus for interior signpost support 106 may support the signpost in a vertical position and prevent the signpost from tipping, rotating, or moving as discussed in relation to FIGS. 2-5. The apparatus for interior signpost support 106 may include one or more portions that may assist a user in placing and positioning the apparatus for interior signpost support 106 in the ground as discussed in relation to FIGS. 6-8.

In one embodiment, the apparatus 100 may include a sign 108. The sign 108 may hang from one or more sign connectors 110. For example, the sign connectors 110 may include one or more loops protruding from the horizontal signpost member 104 and the sign 108 may include one or more fasteners, such as hooks, carbineers, etc., that protrude through the loops. In one embodiment, the sign connectors 110 may include one or more fasteners that protrude from the horizontal signpost member 104 and the sign 108 may include one or more loops or similar devices that that one or more fasteners protrude through. Other embodiments of sign connectors 110 are discussed in relation to FIG. 9 below. The horizontal signpost member 104 may support various types of signs 108.

Figure 2:
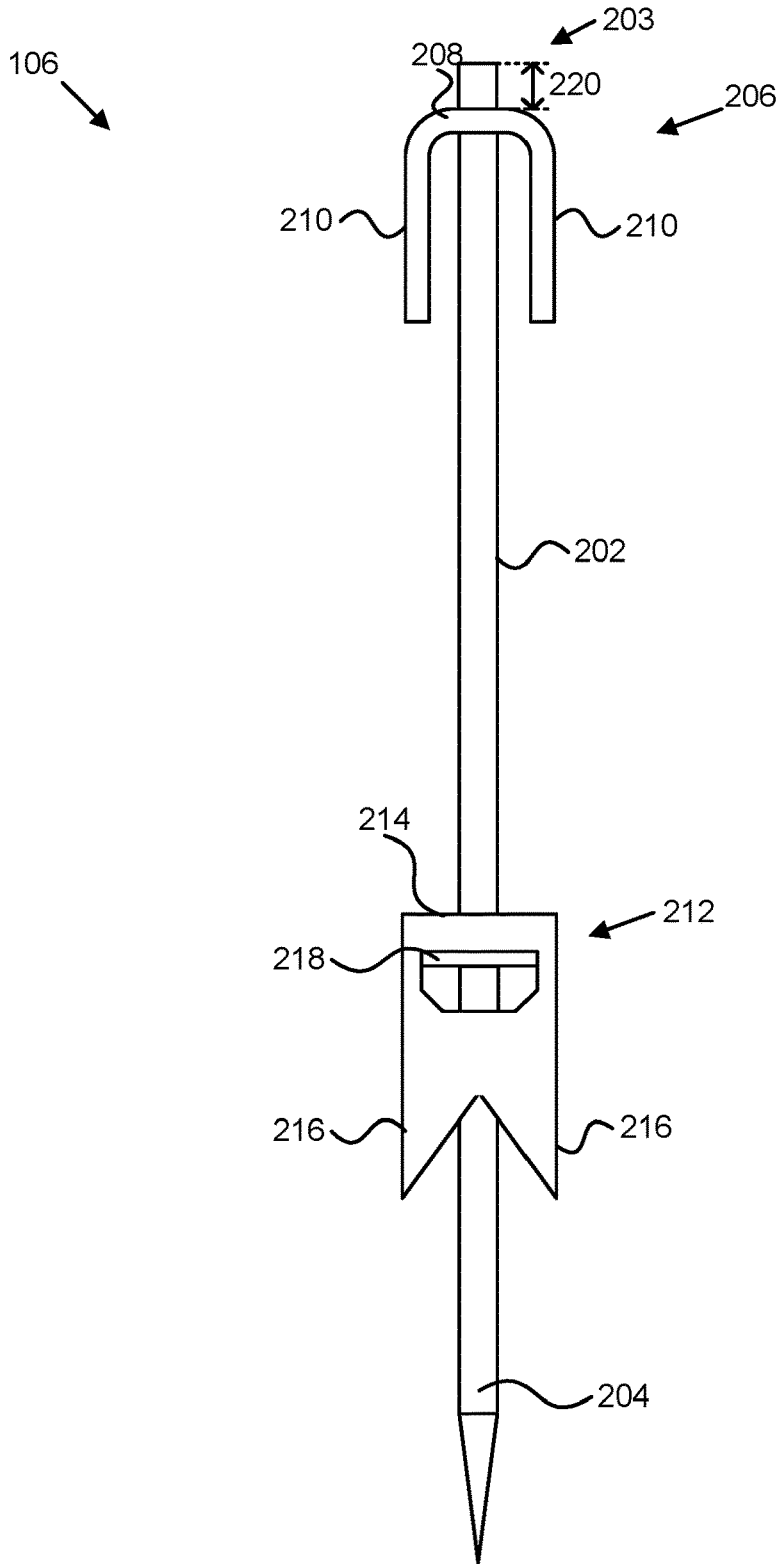
FIG. 2 is a side view illustrating a further embodiment of an apparatus for interior signpost support.

FIG. 2 depicts one embodiment of the apparatus for interior signpost support 106. The apparatus for interior signpost support 106 includes a vertical bar 202 with a first end 203 and a second end 204. The vertical bar 202 may include a second end 204 that is tapered to a point. In one embodiment, the vertical bar 202 includes a rod. The rod may be circular, oval-shaped, square-shaped, rectangular, an angle iron, or another shape. The vertical bar 202 including a circular rod may allow the vertical bar 202 to rotate while a portion of the vertical bar 202 is in the ground. In one embodiment, the vertical bar 202 is rounded on a bottom end toward the second end 204 for a portion that will be inserted into the ground, for example, below a ground anchor 212, which is discussed below, while another portion of the vertical bar 202 is another shape.

A user may rotate the vertical bar 202 to adjust the position of the vertical bar 202 and the vertical signpost member 102 disposed over the vertical bar 202. A vertical bar 202 with at least a portion that will be inserted into the ground that is rounded may accommodate rotation of the vertical bar 202. Other similar shapes, like an oval, may also facilitate rotation of the vertical bar 202. In certain embodiments, the vertical bar 202 may include steel, iron, an alloy, other metal, wood, rigid plastic, fiberglass, or another rigid material. Any material may be used that allows insertion of the vertical bar 202 in the ground while supporting a signpost may be used.

In one embodiment, the apparatus for interior signpost support 106 includes an upper bar 206. The upper bar 206 may couple to the vertical bar 202. In one embodiment, the upper bar 206 may include a center portion 208. The center portion 208 may be substantially perpendicular to the vertical bar 202. As used herein, "substantially perpendicular" means perpendicular or at angles that are almost perpendicular. For example, where perpendicular is 90 degrees, almost perpendicular may include 85 degrees, 89 degrees, 92 degrees, 95 degrees, or other similar angle close to 90 degrees. In one embodiment, substantially perpendicular may include any angle in a range of 80 to 100 degrees.

In some embodiments, the center portion 208 may protrude at an angle from vertical bar 202. For example, one or more portions of the center portion 208 may angle down toward the end second 204, angle up toward the first end 203, a combination of angling up and down (for example, one portion of the center portion 208 may angle down and another portion may angle up), or the like.

The upper bar 206 may include one or more vertical portions 210. In one embodiment, the upper bar 206 may include two vertical portions 210. The one or more vertical portions 210 may couple to the center portion 208. In one embodiment, each vertical portion 210 may couple to the center portion 208 at a point on the center portion 208 located distal to the connection point of the center portion 208 and the vertical bar 202. In one embodiment, the center portion 208 and vertical portions 210 of the upper bar 206 are part of an upper bar 206 of unitary construction. For example, the upper bar 206 may be made of a single piece of metal where the vertical portions 210 are bent away from the center portion 208 as depicted in FIG. 2. Other embodiments include vertical portions 210 connected to the center portion 208, for example by welding the vertical portions 210 to the center portion 208. Various embodiments of the upper bar 206 are discussed below.

In one embodiment, the distance between an exterior edge of the vertical portions 210 may have a width of a diagonal or diameter of an interior of a signpost. For example, the upper bar 206 may include two vertical portions 210. An end of each vertical portion 210 may include an end located distal to the coupling point between the vertical portion 210 and the center portion 208. The distance between the two ends may include a width of a diagonal or diameter of an interior of a signpost, such as a hollow interior of the vertical signpost member 102.

In one embodiment, the apparatus for interior signpost support 106 includes a ground anchor 212. The ground anchor 212 is coupled to the vertical bar 202. The ground anchor 212 may couple to the vertical bar 202 between the upper bar 206 and the second end 204 of the vertical bar 202. The ground anchor 212 includes one or more spikes 216 oriented toward the second end 204 of the vertical bar 202 and a tab 218 oriented away from the vertical bar 202.

The one or more spikes 216 may extend into the ground as the apparatus for interior signpost support 106 is inserted into the ground. The one or more spikes 216 may anchor at least a portion of the ground anchor 212 in the ground. The one or more spikes 216 may prevent the apparatus for interior signpost support 106 from rotating, twisting, or the like when at least a portion of the ground anchor 212 is inserted into the ground and may maintain the signpost in a position determined by a user. In one embodiment, the ground anchor 212 includes a plate 214. The plate 214 may include the one or more spikes 216 oriented toward the second end 204. The one or more spikes 216 may perforate the ground more easily than a flat bottom of the plate 214. In one embodiment, the ground anchor 212 may not include one or more spikes 216 and may include a plate 214 that includes a flat bottom portion (not shown). In another embodiment, the ground anchor 212 may include a smaller plate 214 with spikes 216 coupled to the plate 214, or may not include a plate 214. For example, the ground anchor 212 may be constructed similar to the upper bar 206 and a tab 218 may be coupled to the vertical bar 202.

The ground anchor 212 may include a tab 218 coupled to ground anchor 212 and/or to the vertical bar 202. The tab 218 may extend away from the ground anchor 212. The tab 218 may help to prevent the vertical bar 202, the one or more spikes 216, and/or the plate 214 from penetrating the ground further than the height of the tab 218, or may signal a user to stop inserting the vertical bar 202 once the tab 218 reaches the ground. The tab 218 preventing the ground anchor 212 from penetrating the ground further than the height of the tab 218 may allow a portion of the ground anchor 212 to extend upwards from the ground. The portion of the ground anchor 212 above the tab 218 may engage with one or more sides of an interior of a signpost placed over the apparatus for interior signpost support 106 as described below in relation to FIG. 6. The tab 218 may provide a place for a user to place the user's foot so that the user may push on the tab 218 to drive the second end 204 tapered to a point, one or more spikes 216, the plate 214, or other portions of the apparatus for interior signpost support 106 into the ground.

Figure 3:
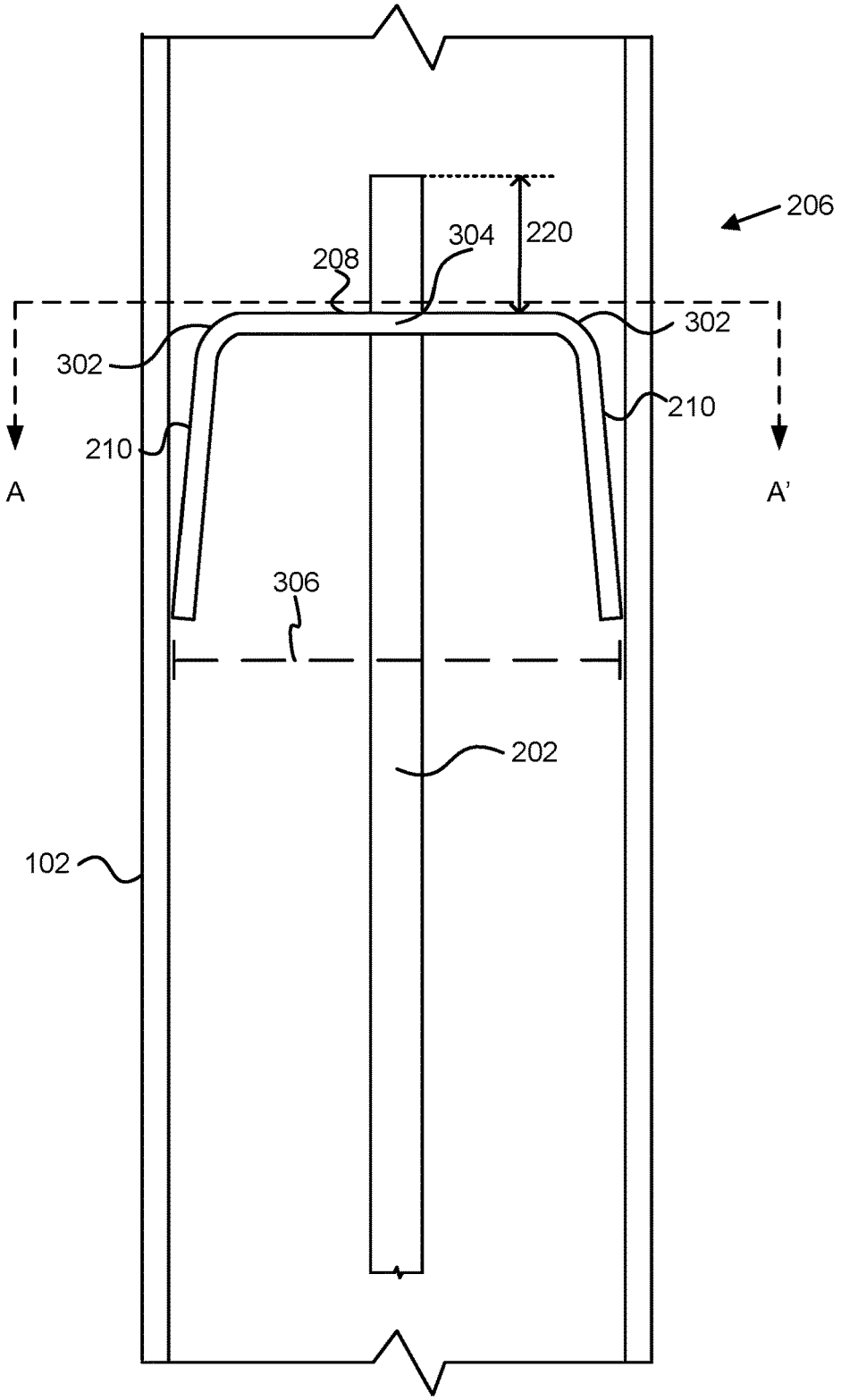
FIG. 3 is a side view illustrating one embodiment of an upper bar of an apparatus for interior signpost support.

FIG. 3 depicts one embodiment of an upper bar 206 of an apparatus for interior signpost support. In one embodiment, the upper bar 206 may include a bendable upper bar 206. For example, the one or more vertical portions 210 may bend at a bend point 302 on the center portion 208 located distal to the connection point 304 of the center portion 208 and the vertical bar 202 as depicted in FIG. 2. In some embodiments, the one or more vertical portions 210 may each bend at separate point 302 on the center portion 208, which may be equidistant from the connection point 304. In certain embodiments, a portion of the center portion 208 may bend at the connection point 304 and a portion of the center portion 208 may bend at another point 302 on the center portion 208. For example, the center portion 208 on either side of the connection point 304 may both angle downward toward the second end 204 at an angle less than vertical. The sides of the center portion 208 may angle upward or downward or may be level.

In one embodiment, bending one or more portions of the upper bar 206 may adjust a distance 306 between the vertical portions 210. In certain embodiments, the distance 306 before bending one or more portions of the upper bar 206 may match a width of a diagonal or diameter of an interior of a signpost, for example, the vertical signpost member 102. The one or more vertical portions 210 may fit against one or more interior corners of the signpost. In another embodiment, the vertical portions 210 fit just inside the signpost to allow for a small amount of movement and to allow for insertion of the signpost over the upper bar 206. For example, the distance 306 before bending one or more portions of the upper bar 206 may include a distance slightly less than the width of a diagonal of the interior of the signpost. A user may then adjust the distance by bending the upper bar 206, for example, by bending the vertical portions 210. The distance 306 after bending one or more portions of the upper bar 206 may match a width of an interior of a signpost. Bending the one or more portions of the upper bar 206 may fit one or more portions of the upper bar 206 against one or more sides of the interior of the signpost and may allow the apparatus for interior signpost support 106 to be used with signposts of various sizes.

In one embodiment, the distance 306 may include a distance larger than a width of a diagonal or diameter of the interior of the signpost. For example, a user may bend the vertical portions 210 of the upper bar 206 beyond a width of the diagonal or diameter of the signpost so that when the signpost is inserted over the upper bar 206, a spring force exists that pushes the vertical portions 210 of the upper bar 206 toward the interior of the signpost. The spring force may hold one or more portions of the upper bar 206 against the interior of the signpost more securely than when the distance is equal to or less than the diagonal or diameter of the signpost.

In certain embodiments, the one or more vertical portions 210 may each include a sharp edge, point, or the like. The sharp edge may be disposed on a vertical portion 210 distal from the end of the vertical portion 210 that connects to the center portion 208. The one or more sharp edges may engage one or more sides the interior of the signpost. The one or more sharp edges engaged with one or more sides of the interior of the signpost may resist or prevent lifting the signpost from off of the apparatus for interior signpost support 106.

In certain embodiments, the portions of the upper bar 206 may include steel, iron, an alloy, another metal, or another bendable material that may provide a spring force as described above. In one embodiment, the center portion 208 and/or the one or more vertical portions 210 of the upper bar 206 may include a rod. The rod may include a circular rod. In some embodiments, the center portion 208 and/or the one or more vertical portions 210 may include a square bar, rectangular bar, angle iron, or other shape of bar.

Returning to FIG. 2, in one embodiment, the upper bar 206 may couple to the vertical bar 202 below a first end 203 of the vertical bar 202 and at a distance from the ground anchor 212. In one embodiment, the distance between the upper bar 206 and the ground anchor 212 may include a distance sufficient to support a signpost in a vertical position. In some embodiments, the signpost, such as the vertical signpost member 102, is placed over the vertical bar 202.

In one embodiment, the distance between the upper bar 206 and the ground anchor 212 is 27 inches (approx. 68.58 cm). In one embodiment, the distance may include a distance greater than 27 inches or less than 27 inches. In certain embodiments, the distance may include a distance sufficient to support a signpost in a vertical position. The distance may increase in response to a variety of factors. For example, in some embodiments, the distance may include a greater distance for a taller signpost than for a shorter signpost. As the height of the signpost increases, the distance may increase. In certain embodiments, the distance may include a greater distance for a signpost with a larger sign 108 than a smaller sign 108. In one embodiment, the distance may increase for use of the apparatus for interior signpost support 106 in locations with high wind speeds, harsh weather elements, or other forces. Generally, as the distance increases, the stability and ability to remain upright of the apparatus for interior signpost support 106 increases. The distance may be calculated based on a distance of the vertical bar 202 in the ground, a height of the signpost, a length of a horizontal signpost member 104, a size of the sign 108, expected wind speed, ground material, etc.

In certain embodiments, the upper bar 206 may couple to the vertical bar 202 below a first end 203 of the vertical bar 202. The upper bar 206 may couple to the vertical bar 202 below the first end 203 a distance 220. In one embodiment, the distance 220 may include a distance sufficient for a user to hold the portion of the vertical bar 202 between the first end 203 and the upper bar 206. In certain embodiments, the distance 220 may include a distance sufficient that a user hammering the first end 203 may not hit one or more portions of the apparatus for interior signpost support 106 such as the upper bar 206. The distance 220, in some embodiments, may include a distance that allows the first end to deform in response to a user hammering the first end without deforming or damaging the upper bar 206. The distance 220 may be within a range of ⅛ of an inch to 6 inches. For example, the distance 220 may be one inch.

In one embodiment, an end of each vertical portion 210 of the upper bar 206 may couple to an end of the center portion 208 of the upper bar 206. Each vertical portion 210 end may couple to an end of the center portion 208 at a point distal to the connection point to the vertical bar 202. In one embodiment, each vertical portion 210 may extend away from the upper end of the vertical bar 202 as depicted in FIG. 2. In one embodiment, each vertical portion 210 may extend up toward the upper end of the vertical bar 202. In one embodiment, one or more vertical portions 210 may extend toward the upper end of the vertical bar 202 and one or more vertical portions 210 may extend away from the upper end of the vertical bar 202. Different vertical portions 210 extending away and toward the upper end of the vertical bar 202 may provide support for a signpost (such as the vertical signpost member 102) at different positions of the interior of the signpost.

Figure 4:
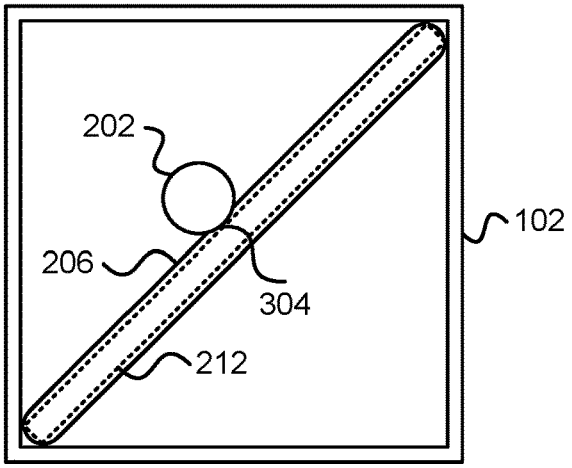
FIG. 4 is a top-down view illustrating a further embodiment of an apparatus for interior signpost support.

FIG. 4 depicts a section view A-A' of an embodiment of an apparatus for interior signpost support 106. In one embodiment, a width of the ground anchor 212 may include a width of a diagonal of an interior of a signpost. For signposts of a different shape, a width of the ground anchor 212 may be a width of a diameter of the signpost. For clarity in showing the width of the ground anchor 212 and the upper bar 206, the tab 218 is not depicted in FIG. 4. The signpost may include the vertical signpost member 102. A width of the upper bar 206 may include a width of a diagonal of an interior of a signpost. The width of the upper bar 206 may include the distance between two or more vertical portions 210 of the upper bar 206. The vertical portions 210 may each be in a bent position and discussed above in relation to FIG. 3. In one embodiment, the vertical portions 210 may each be in a position substantially parallel with the vertical bar 202. While a square vertical signpost member 102 is shown, other shapes may be included, such as a circle, a rectangle, an oval, etc. and the width of the upper bar 206 and ground anchor 212 may match a diameter of the signpost.

Figure 5:
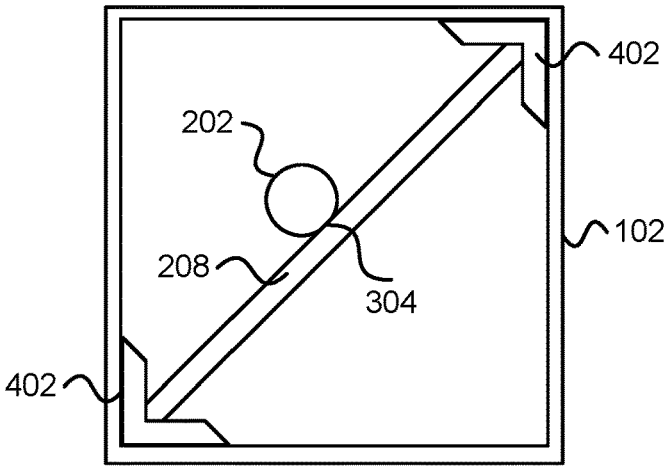
FIG. 5 is a top-down view illustrating a further embodiment of an upper bar of an apparatus for interior signpost support.

FIG. 5 depicts a section view A-A' of another embodiment of an upper bar 206 of an apparatus for interior signpost support 106. In the embodiment, each vertical portion 210 of the upper bar 206 may include an angle iron 402. As used herein, "angle iron" refers to a shape of member with a first portion of the member at a 90 degree angle from a second portion of the member, as depicted in FIG. 5, and does not necessarily refer to a material of the member. For example, an angle iron may be made of aluminum or steel. Each angle iron 402 may couple to the center portion 208 at an interior angle of the angle iron 402 as depicted in FIG. 5. FIG. 5 depicts a top cross-sectional view A-A' of one embodiment of the upper bar where angle irons 402 are viewed from an end. In one embodiment, an angle iron 402 may fit inside a corner of a hollow interior of a signpost, such as the vertical signpost member 102.

Figure 6:
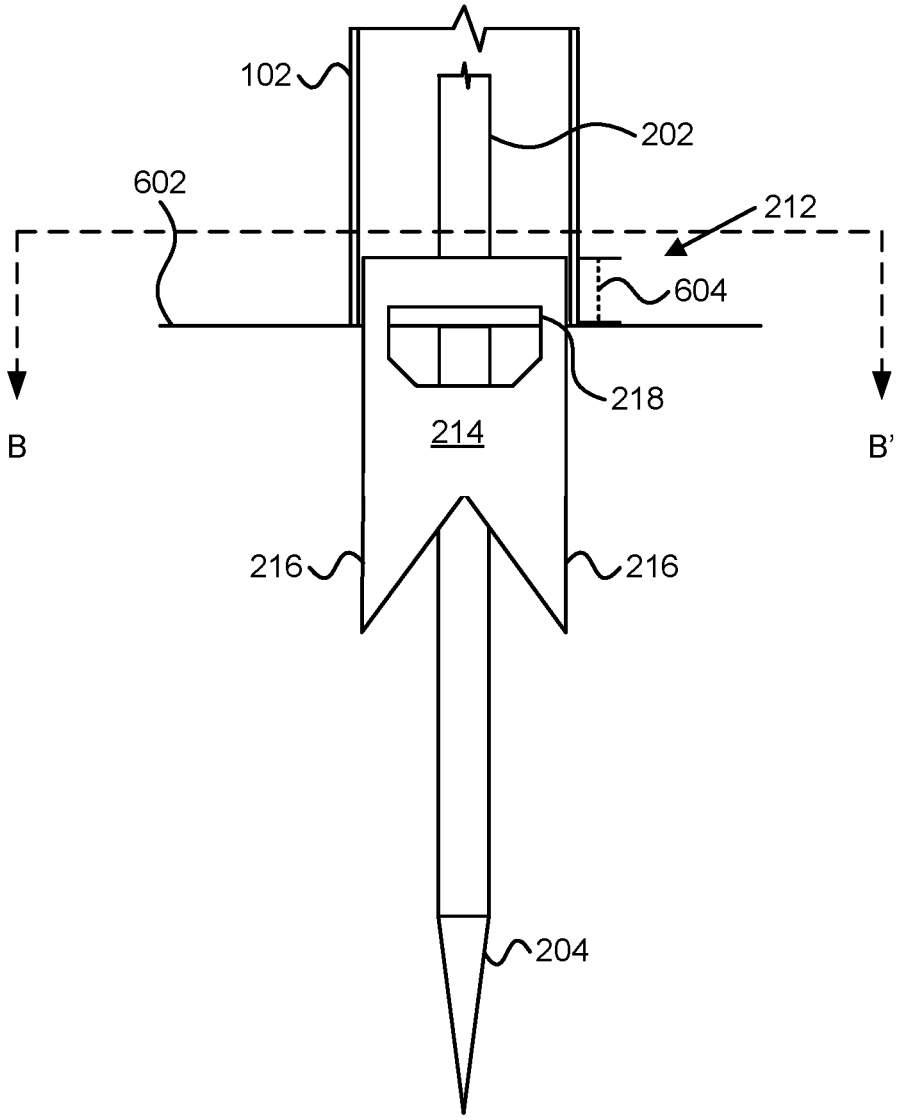
FIG. 6 is a side view illustrating one embodiment of a ground anchor of an apparatus for interior signpost support.

FIG. 6 depicts one embodiment of a ground anchor 212 of an apparatus for interior signpost support with a plate 214 forming the ground anchor 212. In one embodiment, a portion of the plate 214 may extend toward the upper end of the vertical bar 202 and away from the tab 218. In certain embodiments, the tab 218 may engage with the ground 602. In certain embodiments, the portion of the plate 214 extending towards the upper end of the vertical bar 202 may extend an amount 604 sufficient to engage an edge of an interior of a signpost disposed over the plate 214. The signpost may include the vertical signpost member 102. The portion of the plate 214 may provide support to a base of the signpost disposed over the plate 214. In some embodiments, the amount 604 may be sized for ground 602 with certain terrain considerations such as vegetation, rocks, or the like. For example, the amount 604 may include a larger amount 604 for a terrain with large vegetation, a large amount of vegetation, or a large amount of rocks or other debris on the ground 602. The larger amount 604 may push up the signpost disposed over the ground anchor 212.

In one embodiment, the amount 604 of the plate 214 that engages the interior of the signpost may include an amount 604 sufficient to remain vertical in response to external forces such as wind and other weather elements as discussed above. The amount 604 may prevent the opening at the bottom of the vertical signpost member 102 from slipping off the plate 214. In one embodiment, the plate 214 and/or tab 218 may include a thickness sufficient to be inserted into the ground 602. For example, in one embodiment, the thickness may include a thickness of 0.125 inches (approx. 0.32 cm). In one embodiment, the thickness may include a thickness greater than or less than 0.125 inches. A user may hammer the vertical bar 202 and/or the plate 214 so that the plate 214 and/or the tab 218 go into the ground 602 and the thickness of the plate 214 and/or tab 218 may include a thickness sufficient to prevent twisting, warping, bending out of shape, or the like. In certain embodiments, the strength of the material of the plate 214 may prevent the plate 214 from twisting, warping, or the like. A stronger material for the plate 214 may allow for a thinner plate 214 than a softer material. In one embodiment, the distance from the end of a spike 216 to the second end 204 tapered to a point may include a distance of 15.1 inches (approx. 38.35 cm). In one embodiment, the distance may include a distance greater than or less than 15.1 inches.

Figure 7:
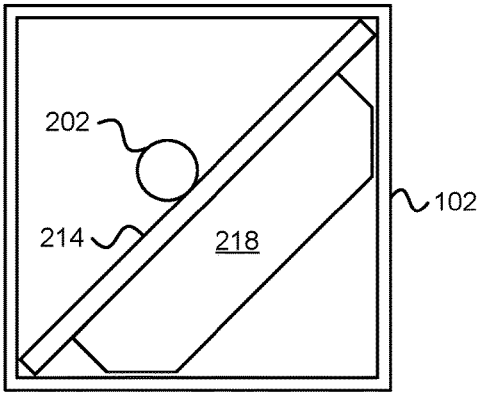
FIG. 7 is a top-down view illustrating a further embodiment of a ground anchor of an apparatus for interior signpost support.

FIG. 7 depicts a cross section B-B' of one embodiment of a ground anchor 212 of an apparatus for interior signpost support. In one embodiment, the tab 218 is sized to fit within an interior of the vertical signpost member 102. For example, as depicted in FIG. 7, one or more edges of the tab 218 may engage one or more sides of the signpost. The tab 218 may be shaped to closely fit against the sides of the interior of the vertical signpost member 102. For example, as depicted in FIG. 7, one or more corners of the tab 218 may include clipped corners and the clipped corners may engage one or more edges of the interior of the signpost. The tab 218 may provide support to the vertical signpost member 102. In one embodiment, one or more edges of the tab 218 may extend up and engage with one or more sides of the interior of the vertical signpost member 102. The one or more extended edges may support the vertical signpost member 102. In one embodiment, the width of the tab 218 (the distance from the plate 214 to the edge of the tab 218) may include 1.25 inches (approx. 3.175 cm). In one embodiment, the width of the tab 218 may include a width greater than or less than 1.25 inches.

In another embodiment, the tab 218 is shaped to extend outside the interior of the signpost (not shown). For example, the tab 218 may provide a resting place for the signpost. The signpost may slip over the apparatus for interior signpost support 106 down to the tab 218 to prevent the signpost from extending below the tab 218, for example, into soft earth, mud, etc.

Figure 8A:
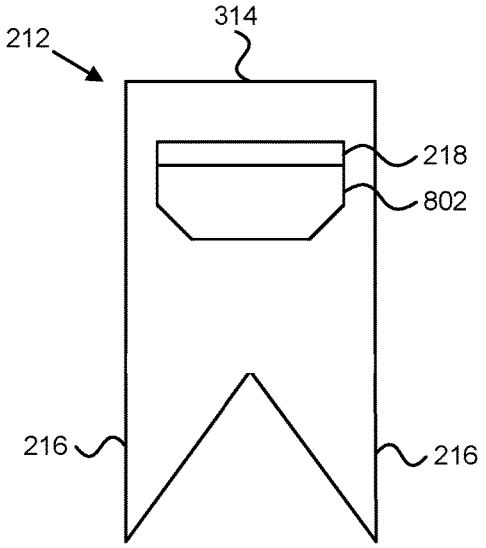
FIG. 8A is a side view illustrating a further embodiment of a ground anchor of an apparatus for interior signpost support.
Figure 8B:
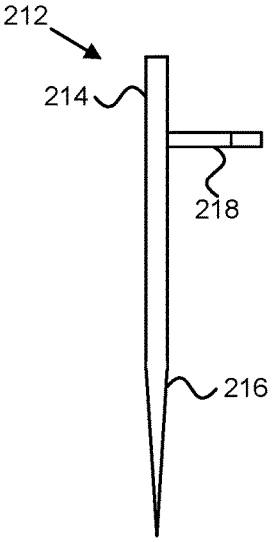
FIG. 8B is a side view illustrating a further embodiment of a ground anchor of an apparatus for interior signpost support.

FIG. 8A and FIG. 8B depict one embodiment of a plate 214. In one embodiment, the tab 218 may be cut and bent out from the plate 214. In one embodiment, the plate 214 may include a window 802. The window 802 may include a hole that includes the shape of the tab 218. The tab 218 may be cut and bent out of the window 802. In certain embodiments, the tab 218 may couple to the plate 214. For example, the tab 218 may be welded, bolted, riveted, screwed, adhered, or the like to the plate 214. In one embodiment, the plate 214 may include a width of 5 inches (approx. 12.7 cm). In one embodiment, the plate 214 may include a width greater than or less than 5 inches and may be sized for a signpost. In one embodiment, the length of the plate 214 (the distance from the top of the plate 214 to the tip of the one or more spikes 216) may include a length of 5.9 inches (approx. 15 cm). In one embodiment, the length of the plate 214 may include a length greater than or less than 5.9 inches. In one embodiment, the one or more spikes 216 may be coupled to the plate 214. The one or more spikes 216 may be welded, riveted, bolted screwed, adhered, or the like to the plate 214. In one embodiment, the one or more spikes 216 may be formed from the same piece of material as the plate 214.

In one embodiment, the tab 218 may be oriented substantially perpendicular to the vertical bar 202 as depicted in FIG. 8B. In one embodiment, the tab 218 may be oriented at an angle to the vertical bar 202. A user may adjust the angle between the tab 218 and the vertical bar 202. For example, a user may bend the tab 218 to adjust for a size of an interior of a signpost. In one embodiment, the user may bend the tab 218 to adjust for the shape, texture, or the like of the surface of the ground.

In one embodiment, the plate 214 may include two spikes 216 oriented toward the second end 204 tapered to a point of the vertical bar 202. In certain embodiments, each spike may include a tip located at a vertical edge of the plate 214 as depicted in FIG. 8A, or located at a point between the vertical edge and the center of the plate 214. In one embodiment, each spike may include a tip located underneath the plate 214 and between the vertical edges of the plate 214 and may assist a user in driving a portion of the plate into the ground. The location of each tip and or the angle of each spike may prevent the plate 214 from twisting, warping, or the like.

In some embodiments, the plate 214 may include one spike 216. The spike 216 may be disposed in the middle of the bottom of the plate 214. In another embodiment, the spike 216 is disposed a distance away from the middle of the bottom of the plate 214, at an edge of the plate 214, or in between the center and edge of the plate 214. For example, a single spike 216 may be adequate to prevent twisting, warping, etc. In one embodiment, the plate 214 may include more than two spikes 216. In certain embodiments, multiple spikes 216 may increase the stability of the apparatus for interior signpost support 106 and/or may prevent the apparatus for interior signpost support 106 from twisting, rotating, dislocating, or the like in the ground.

In one embodiment, the apparatus for interior signpost support 106 may be constructed easily and economically. For example, in certain embodiments, the apparatus for interior signpost support 106 includes a sharpened rod (such as vertical bar 202), a bent rod (such as upper bar 206), and a stamped plate (such as ground anchor 212). A user may easily bend the bent rod to adjust for different signpost sizes. The bent rod may be inexpensively connected to the sharpened rod. The stamped plate may include a tab that bends out and the stamped plate may inexpensively connect to the sharpened rod. Other apparatuses that may support a signpost may include more components, more expensive components, and components that a user may not be able to adjust easily. Other apparatuses may include more components coupled to each other in more expensive ways.

Figure 8C:
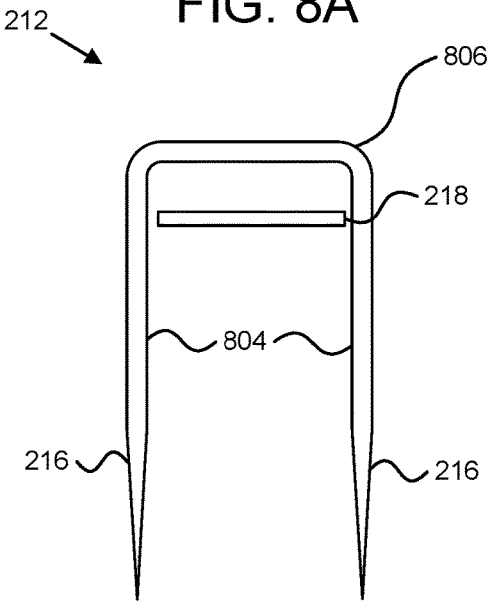
FIG. 8C is a side view illustrating an alternate embodiment of a ground anchor of an apparatus for interior signpost support.

FIG. 8C is a side view illustrating an alternate embodiment of a ground anchor 212 of an apparatus for interior signpost support 106. In the embodiment, the ground anchor 212 includes a modification from the depicted plate 214 of FIGS. 2, 8A and 8B so that the ground anchor 212 includes a bent rod forming spikes 804 connected to the vertical bar 202, to a plate 214 (not shown), or similar structure. The tab 218 may be connected directly to the vertical bar 202 and/or to the spikes 216.

In another embodiment (not shown), instead of a bent rod, the ground anchor 212 may include one or two straight rods forming the spike(s) 216 with a connecting portion in between the spikes 216. For example, the connecting portion may include an angle iron, a rod, a plate, etc. The spikes 216 may extend above the connecting portion to extend above the tab 218 into the signpost so that the spikes 216 and connecting portion form an "H" shape with the connecting portion offset toward the top so there is a distance 604 above the tab 218 sufficient to engage the signpost.

In one embodiment with a plate 214 (not shown), one or more spikes 216 may be connected to a plate 214 extending upward from the tab 218. The spikes 216 may be formed with a bent rod or may be connected directly to the plate 214. The plate 214 may extend to the tab 218 or may be longer and the spikes 804 may connect to the plate 214. In one embodiment, the spikes 804 are part of the plate 214 and have a thickness the same as the plate 214. The embodiment may use less material than the plate 214 depicted in FIG. 8A. Strength of spikes 804 may require a stiffer material than the plate of FIG. 8A.

All or a portion of the apparatus for interior signpost support 106 may be constructed of a metal, such as steel, iron, aluminum, etc., or may be made of one or more materials that are rigid enough to support a signpost and to be driven into the ground. The materials may include a plastic, a composite, fiberglass, etc. The apparatus for interior signpost support 106 may be made of two or more materials. The vertical signpost member 102 and the horizontal signpost member 104 may be made of plastic, aluminum, tin, or other material suitable for supporting a sign 108 while supported by the apparatus for interior signpost support 106. One of skill in the art will recognize appropriate materials for constructing the signpost apparatus 100.

Figure 9:
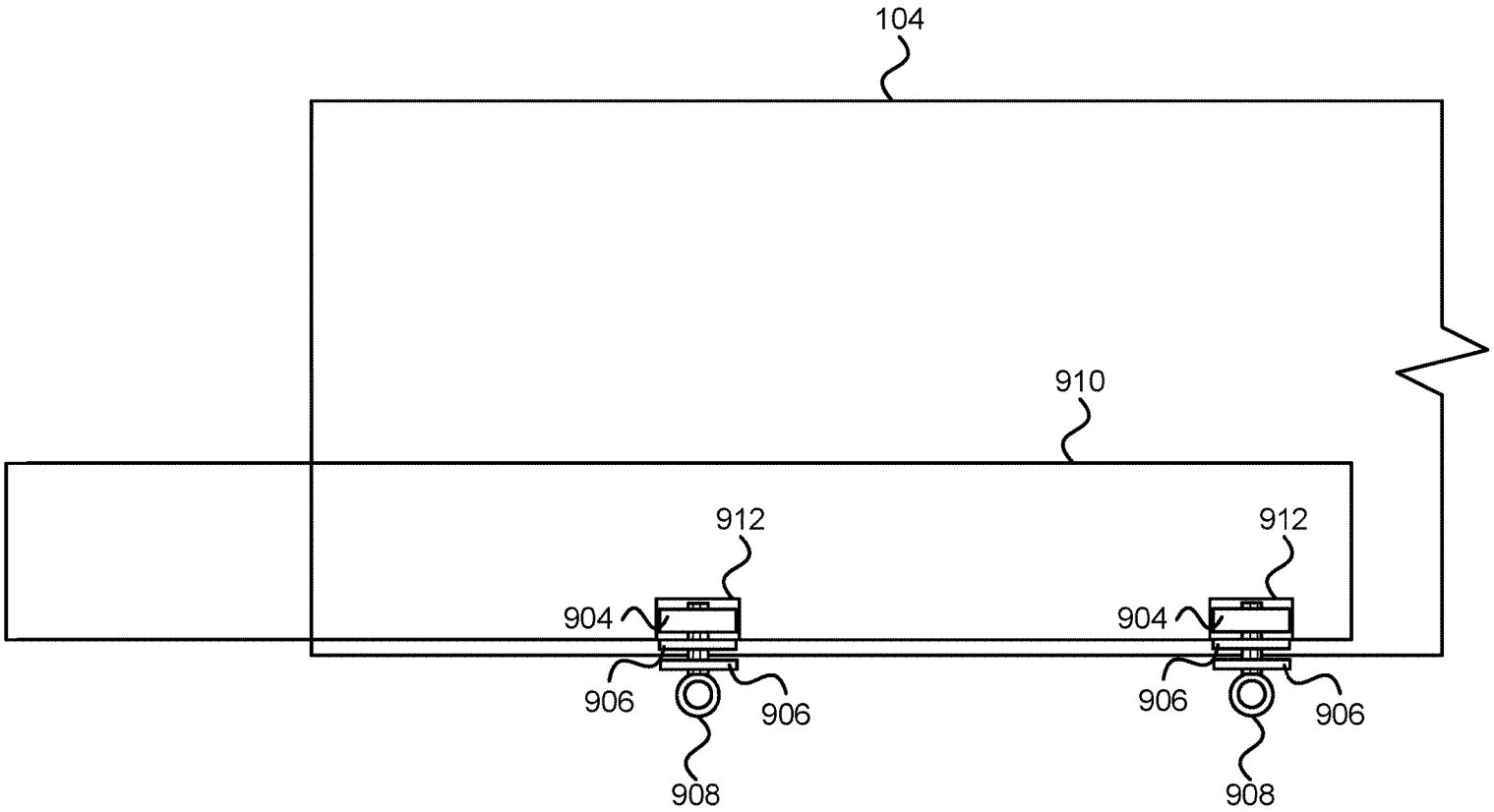
FIG. 9 is a side view illustrating one embodiment of a horizontal signpost member of an apparatus for interior signpost support.

FIG. 9 depicts a portion of one embodiment of a horizontal signpost member 104. The horizontal signpost member 104 includes one or more nuts 904, one or more washers 906, and one or more fasteners 908. The horizontal signpost member 104 may include a hollow interior. As discussed above in relation to FIG. 1, the horizontal signpost member 104 may couple to the vertical signpost member 102. For example, the horizontal signpost member 104 may protrude through an opening of the vertical signpost member 102.

The horizontal signpost member may attach to a side of the vertical signpost member 102.

In one embodiment, the horizontal signpost member 104 may include one or more openings. The one or more openings may be disposed on a side of the horizontal signpost member 104. In one embodiment, a user may create the one or more openings. For example, a user may drill, puncture, or the like through the horizontal signpost member 104 to form the one or more openings. The user may create the openings to align the openings with one or more sign connectors 110 (for example, one or more hooks) of the sign 108.

In one embodiment, the horizontal signpost member 104 may include one or more nuts 904. Each nut 904 may couple to an interior edge of the horizontal signpost member 104. Each nut 904 may be disposed over an opening of the horizontal signpost member 104. In one embodiment, the horizontal signpost member 104 may include one or more washers 906. A washer 906 may be disposed between a nut 904 and the horizontal signpost member 104. A washer 906 may fit against an exterior portion of a nut 904. A washer 906 may be disposed on the exterior of the horizontal signpost member 104.

In one embodiment, the horizontal signpost member 104 may include one or more fasteners 908, such as eyebolts. Each fastener 908 may secure to a nut 904. In one embodiment, a fastener 908 may protrude through one or more washers 906 and screw into the nut 904. The one or more fasteners 908 may provide a ring, loop, or the like that may hold a hook. The fasteners 908 may be an eyebolt, a hook, etc. One or more hooks may protrude from a sign, such as the sign 108 of FIG. 1.

In one embodiment, a user assembling one or more components of the horizontal signpost member 104 may use a jig 910. The jig 910 may include a piece of material longer than a length between openings in the horizontal signpost member 104 for the fasteners 908. The jig 910 may include one or more sockets 912 disposed on a side of the jig 910. The user may insert the jig 910 into the horizontal signpost member 104 through a side opening in the side of the horizontal signpost member 104 as depicted in FIG. 9. The one or more sockets 912 may align with the one or more openings of the horizontal signpost member 104. The user may place a nut 904 and a washer 906 over each socket 912. The user may place the nut 904 and washer 906 before inserting the jig 910 into the horizontal signpost member 104. After securing the one or more fasteners 908 to the horizontal signpost member 104 as described above, the user may remove the jig 910 from the horizontal signpost member 104. The user may turn over the horizontal signpost member 104 and the one or more fasteners 908 may face down. The user may place one or more hooks through the loops of the one or more fasteners 908 and the one or more hooks may connect to a sign 108.

In one embodiment, a method for assembling the horizontal signpost member 104 may include providing the jig 910. The jig 910 may include one or more sockets. For example, the sockets may include the one or more sockets 912. The one or more sockets may face up. The method may include disposing a nut 904 inside each socket 912. The method may include disposing a washer 906 over each nut 904. The method may include disposing a horizontal signpost member 104 over the jig 910. For example, the horizontal signpost member 104 may slide over the jig 910. The horizontal signpost member 104 may include one or more openings that align with the one or more sockets 912 of the jig 910. The method may include disposing a washer 906 over each opening of the horizontal signpost member 104. The method may include securing a fastener 908 to each nut 904. The method may include removing the 910 jig from the horizontal signpost member 104 once the fasteners 908 are secured to the nuts 904.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A signpost for supporting a sign, comprising:

a vertical bar comprising a first end and a second end;

an u-shaped upper bar coupled to the vertical bar, the upper bar comprising a center portion substantially perpendicular to the vertical bar and two vertical portions coupled to the center portion, each vertical portion coupled to the center portion distal to a connection point to the vertical bar; and a ground anchor rigidly connected to the vertical bar, prior to use, at a fixed position between the upper bar and the second end of the vertical bar a distance above the second end of the vertical bar, the ground anchor comprising one or more spikes oriented toward the second end of the vertical bar, wherein the one or more spikes are a distance above the second end of the vertical bar, and a tab oriented extending away from the vertical bar and away from a top of the one or more spikes in a direction perpendicular to the vertical bar and the one or more spikes.

2. The apparatus of claim 1 further comprising a vertical signpost member comprising a hollow interior.

3. The apparatus of claim 2, further comprising a horizontal signpost member coupled to the vertical signpost member, the horizontal signpost member comprising a hollow interior, and further comprising:

one or more nuts aligned with an edge of the horizontal signpost member, and one or more eyebolts, each eyebolt secured to a nut of the one or more nuts.

4. The apparatus of claim 1, wherein the vertical bar comprises a rod and the second end is tapered to a point.

5. The apparatus of claim 1, wherein the upper bar is bendable to adjust a distance between the two vertical portions to match a width of an interior of a signpost.

6. The apparatus of claim 1, wherein the upper bar couples to the vertical bar below the first end of the vertical bar at a distance from the ground anchor.

7. The apparatus of claim 6, wherein the distance comprises a distance sufficient to support a signpost in a vertical position when the vertical bar is inserted into a ground to a depth of the ground anchor, wherein the signpost is placed over the vertical bar.

8. The apparatus of claim 1, wherein an end of each vertical portion of the upper bar couples to an end of the center portion of the upper bar distal to the connection point of the center portion to the vertical bar, and wherein each vertical portion extends away from the first end of the vertical bar.

9. The apparatus of claim 1, wherein each of the vertical portions of the upper bar comprise an angle iron, each angle iron coupled to the center portion of the upper bar at an interior angle of the angle iron.

10. The apparatus of claim 1, wherein the ground anchor comprises a plate comprising the one or more spikes and the tab, a width of the plate and a width of the upper bar each comprise a width comprising a diagonal of an interior of a signpost.

11. The apparatus of claim 1, wherein a portion of the ground anchor extends toward the first end of the vertical bar a distance away from the tab.

12. The apparatus of claim 11, wherein the portion of the ground anchor extending towards the first end of the vertical bar extends an amount sufficient to engage an edge of an interior of a signpost disposed over the ground anchor.

13. The apparatus of claim 1, wherein the tab is shaped to fit within an interior of a signpost.

14. The apparatus of claim 1, wherein the ground anchor comprises a plate, the plate comprising the one or more spikes and the tab, the plate comprises a cut and the tab comprises a portion under the cut bent away from the plate.

15. The apparatus of claim 1, wherein the tab is oriented perpendicular to the vertical bar.

16. The apparatus of claim 1, wherein the ground anchor comprises two spikes oriented toward the second end of the vertical bar, each spike having a tip located at a vertical edge of the ground anchor.

17. A signpost system for supporting a sign, comprising:

a signpost support apparatus comprising:

a vertical bar comprising a first end and a second end, the second end tapered to a point;

an u-shaped upper bar coupled to the vertical bar, the upper bar comprising a center portion substantially perpendicular to the vertical bar and two vertical portions coupled to the center portion, each vertical portion coupled to the center portion distal to a connection point to the vertical bar; and a ground anchor rigidly connected to the vertical bar, prior to use, at a fixed position between the upper bar and the second end of the vertical bar a distance above the second end of the vertical bar, the ground anchor comprising a plate comprising one or more spikes oriented toward the second end of the vertical bar, wherein the one or more spikes are a distance above the second end of the vertical bar, and a tab coupled to the ground anchor and oriented extending away from the plate and away from a top of the one or more spikes in a direction perpendicular to the vertical bar and the one or more spikes; and a signpost comprising:

a vertical signpost member comprising a hollow interior, the vertical signpost member inserted over the signpost support apparatus; and a horizontal signpost member coupled to the vertical signpost member, wherein a width of the plate and a width of the upper bar each comprise a width comprising a diagonal of an interior of a signpost.

18. The system of claim 17, wherein the horizontal signpost member comprises a hollow interior, and further comprising:

one or more nuts aligned with an edge of the horizontal signpost member, and one or more eyebolts, each eyebolt secured to a nut of the one or more nuts.

19. A signpost for supporting a sign, comprising:

a vertical bar comprising a first end and a second end, the second end tapered to a point, the vertical bar comprising a rod;

an u-shaped upper bar coupled to the vertical bar, the upper bar comprising a center portion substantially perpendicular to the vertical bar and two vertical portions coupled to the center portion, each vertical portion coupled to the center portion distal to a connection point to the vertical bar, an end of each vertical portion of the upper bar couples to an end of the center portion of the upper bar distal to the connection point of the center portion to the vertical bar, each vertical portion extends away from the first end of the vertical bar, wherein the upper bar is bendable to adjust a distance between the two vertical portions to match a width of an interior of a signpost; and a ground anchor coupled to the vertical bar between the upper bar and the second end of the vertical bar, the ground anchor comprising:

a plate comprising one or more spikes oriented toward the second end of the vertical bar, and a tab coupled to the ground anchor and oriented extending away from the plate, the tab oriented perpendicular to the vertical bar, wherein a portion of the plate extends toward the first end of the vertical bar a distance away from the tab, wherein the portion of the plate extending towards the first end of the vertical bar extends an amount sufficient to engage an edge of an interior of the signpost disposed over the plate, wherein the upper bar couples to the vertical bar below the first end of the vertical bar at a distance from the ground anchor and wherein the distance comprises a distance sufficient to support the signpost in a vertical position when the vertical bar is inserted into a ground to a depth of the ground anchor, wherein the signpost is placed over the vertical bar, wherein a width of the plate and a width of the upper bar each comprise a width comprising a diagonal of an interior of a signpost.

20. The apparatus of claim 19, further comprising the signpost, the signpost comprising:

a vertical signpost member comprising a hollow interior; and a horizontal signpost member coupled to the vertical signpost member, the horizontal signpost member comprising a hollow interior, and further comprising:

one or more nuts aligned with an edge of the horizontal signpost member, and one or more eyebolts, each eyebolt secured to a nut of the one or more nuts.

* * * * *